US005421961A

United States Patent [19]

Miller

[11] Patent Number: 5,421,961

[45] Date of Patent: Jun. 6, 1995

[54] FORMING BOARD POSITION CONTROL SYSTEM

[76] Inventor: Joseph Miller, #3 Thornwood Dr., Fort Edward, N.Y. 12828

[21] Appl. No.: 313,925

[22] Filed: Sep. 26, 1994

[51] Int. Cl.[6] ..... D21F 1/54

[52] U.S. Cl. ..... 162/252; 162/351; 162/352; 162/354

[58] Field of Search ..... 162/252, 256, 262, 351, 162/352, 354, DIG. 10, 11

[56] References Cited

U.S. PATENT DOCUMENTS

| | | | |
|---|---|---|---|
| 3,997,390 | 12/1976 | Kankaanpaa | 162/303 |
| 4,416,731 | 11/1983 | Pesonen et al. | 162/352 |
| 4,523,978 | 6/1985 | Pullinen | 162/352 |
| 4,623,429 | 11/1986 | Tissari | 162/352 |
| 4,684,441 | 8/1987 | Ibrahim | 162/352 |
| 5,203,967 | 4/1993 | Bando et al. | 162/301 |

*Primary Examiner*—Karen M. Hastings

*Attorney, Agent, or Firm*—John J. Welch, Jr.

[57] ABSTRACT

The instant device is a forming board position control system. A forming board fitted with the instant invention is positioned at various distances from and with virtually perfect constant parallelarity to the lie of the frontal plane of a headbox in apposition to the forming board. A computer controlled motor causes a parallelwise positioned pair of worm gear jacks mounted to the board, to move the board longitudinally to and fro through a distance from the frontal plane of the headbox as is determined with reference to manually manipulated computerized settings until the system stops perforce of a signal to such effect received by a controller computer as the result of interaction as between a magnet affixed to the base of one of two mounting plates to which the board is also mounted and a transducer closely positioned thereto and connected directly to the computer.

6 Claims, 8 Drawing Sheets

FIG. 4
PRIOR ART
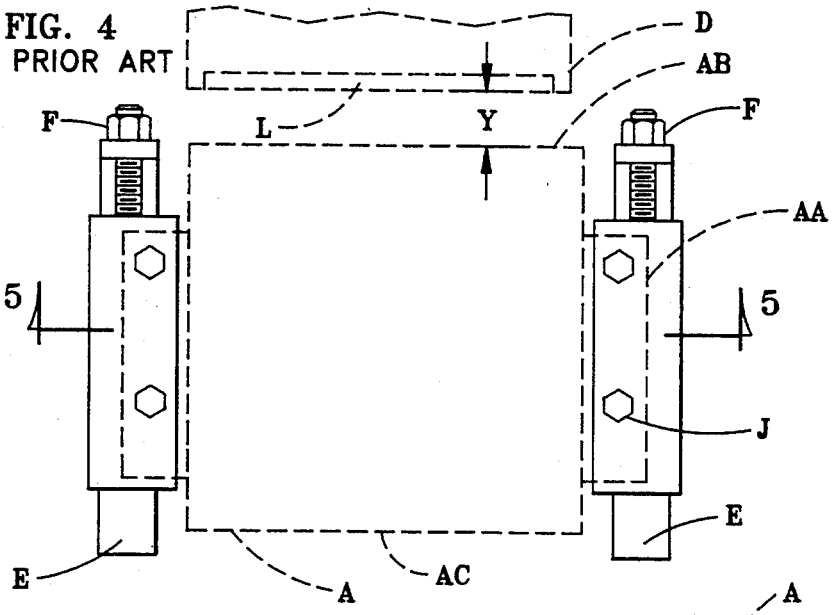
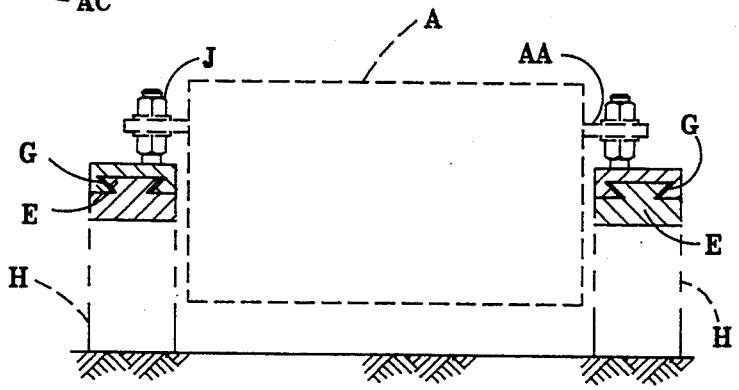
FIG. 5
PRIOR ART
FIG. 6
PRIOR ART
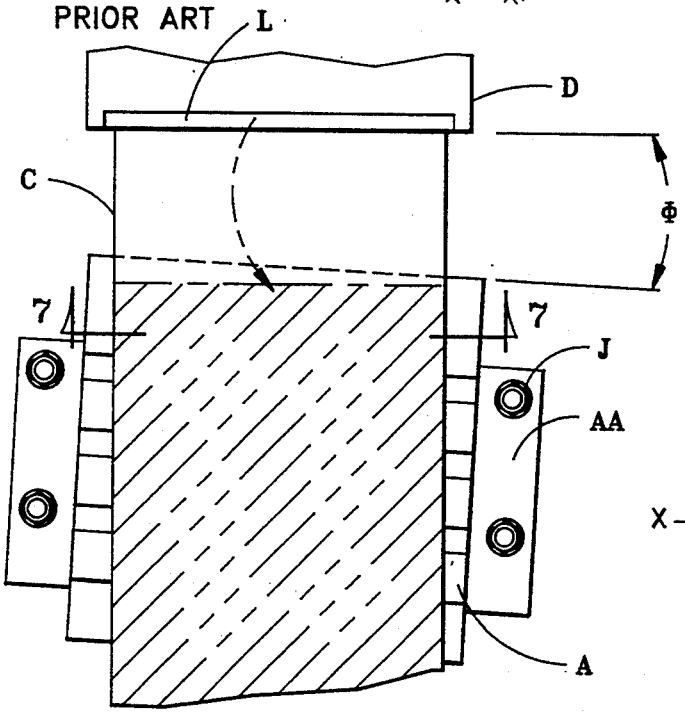
FIG. 7
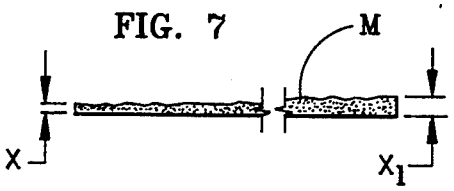

FORMING BOARD POSITION CONTROL SYSTEM

BACKGROUND OF THE INVENTION

1. Field of the Invention

The instant invention is related to that group of devices that serve-as improvements upon papermaking forming boards especially as respects stabilization of positioning in such forming boards.

2. Possible Prior Art

The following references exemplify prior art that bears somewhat upon the essence of the instant invention, to wit:

| Inventor | Invention | U.S. Pat. No. | Date |
|---|---|---|---|
| 1. Ibrahim | A Method for Operably Adjusting a Leading Forming Board Strip | 4,684,441 | 08/04/87 |
| 2. Lebeau, et al | Control System for Papermaking Machine Headbox | 4,374,703 | 02/22/83 |
| 3. Duecker | Paper Web Alignment Box | 5,087,313 | 02/11/92 |
| 4. Bando et al | Twin-Wire Former in Paper Machine | 5,203,967 | 04/20/93 |
| 5. Balakrishman et al | Process and System for Controlling the Basis Weight of a Sheet Material | 5,009,748 | 04/23/91 |
| 6. Kankaanpaa | Twin-Wire Paper Machine and Method for Operating the Same | 3,997,390 | 12/14/76 |
| 7. Brieu | Apparatus for Effecting the Fine-Adjustment of the Lip of a Head-Box of a Paper Making Machine | 4,406,740 | 09/27/83 |

A SUMMARY OF THE INVENTION

A BRIEF DESCRIPTION OF THE INVENTION

The instant invention is a device that serves to stabilize with true parallelarity the longitudinal positioning of a papermaking forming board in relation to the locus of the slice of the headbox of a papermaking machine from which there is emitted a continuous jet of papermaking slurry. A digital control panel unit in response to digital settings pre-selected by an operator causes a motor that is wire connected to the panel to actuate the turning of worm gear screw jacks that results in the movement longitudinally to and fro of the forming board where such movement continues until a signal induced by a magnet mounted to the forming board, upon a transducer in apposition thereto and likewise wire connected to the panel unit, causes the panel unit to stop the motor from any longer actuating the turning of the previously mentioned worm gear jacks. The motor is encompassed by an interfaced sealed cover to protect it from spray and materials emanating from the headbox slice. The motor is further so protected by an O ring that facilitates as well such encompassing of the motor.

A pair of base plates that are each component parts of the instant invention just as are the above-mentioned panel, motor, transducer, magnet and wiring et al are welded, parallel to one another, permanently to each to one of two basestands upon each of which a forming board fitted with the whole of the instant invention is ultimately mounted. Affixed to each such base plate are further components of the invention, to wit: tracks in parallel position to each other. Affixed to each such track are still further components, namely two saddles per track that are each movable and positioned each a set distance from the other. Affixed to each of both saddles on each track upon each such base plate is a fiat forming board mounting plate to which a forming board is attached and leveled. These two mounting plates are also components of the invention. Such leveling is accomplished by way of four leveling nuts and bolts, two to a side serving to connect the mounting plates respectively to the forming board. The leveling assemblies are also components of the invention. Each track and saddle unit is covered by a boot made of vulcanized rubber or cloth serving to protect each unit from spray or material buildup. The motor and worm gear jacks are each affixed to a first mounting bracket and a second mounting bracket respectively each of which are further components of the invention and each of which are respectively welded to the forming board. The worm gear jacks actuated by the motor further by way of a drive shaft affixed ultimately to the motor via a shaft coupling unit operate in unison to move the forming board over time longitudinally through a distance of from less than a fraction of an inch up to a distance of six inches. Pillow block bearings affixed to spacer blocks mounted to the forming board hold the drive shaft in place. A handwheel exists on the passive side of the forming board system to allow for effectuation of longitudinal movement during periods of time marked by power failures. The motor with a mechanical advantage of 149:1 serves to permit, in conjunction with the other components of the system, longitudinal movement at the rate of an inch a minute with a start-stop tolerance of no more than 0.005 of an inch.

OBJECT OF THE INVENTION

Paper making machine are designed to operate on virtually a continuous twenty four hour basis. The proper combination of water, pulp and chemicals is constantly fed into a machine's headbox to be emanated under pressure onto a forming board via a slice in the headboard to continually effectuate papermaking. Such machines are shut down relatively briefly on a scheduled intermittent, for example; once every three week basis, for maintenance purposes. Due to the overall size and hence inertia as well as complexity of such machines, it is extremely difficult and most cost-ineffective to shut down such machines at any other time. The difficulty with such machines currently in use is that when it is desired to alter the thickness or bond of paper being formed, such machines currently in use must, of necessity, be manipulated while running by way of, for example, simultaneous right and left side manual adjustments of the forming board in an attempt to position its headside at not only a desired longitudinal distance from the headbox but also hopefully exactly parallel to the frontal plane of the headbox; since uniformity of thickness depends on pure parallelarity. Such adjustments are however difficult to accomplish with any predictable degree of high precision because they're done by hand according to approximations with naked eyes alone, and to the extent that such adjustments are not exact in respect of pure parallelarity, the result is paper produced with uneven thickness. Such adjustments occur four to five times a day and take thirty to sixty minutes each to complete. They are difficult, at best, to accomplish while a paper making machine is running, "on the fly" as it were. During the course of each such adjustment, paper is formed and concomitantly lost at the rate of roughly 2700 feet per minute. If a good size mill has four machines running, then, four machines times any four 30 minute adjustments each times 2700 adds up to over 1.2 million feet of paper lost each day per mill. Granted, much of this paper can be recovered during recycling, but this involves much time and expense. More importantly however notwithstanding recycling efforts, virtually all of the chemicals in such paper that were part and parcel of the original slurry emanating from a machine's headbox as the seminal dynamic papermaking step are lost when they leach out during recycling and this also involves tremendous expense.

However, the instant invention obviates completely the whole of the foregoing scenario of concern as respects not only downtime and expense but also as respects a relative lack of constancy and lack of uniformity of the thickness or bond of paper being produced. Once a given forming board is fitted or, in the case of an older forming board retrofitted with the instant invention, longitudinal adjustments are able to be made with pure parallelarity under the control of a computer driven motor within start-stop tolerances of no more than 0.005 inches. In view of the same, there is accordingly virtually no side to side variation in the predetermined desired thickness or bond of paper to be produced. The instant invention permits forward movement longitudinally of a forming board from a zero point significantly closer to the plane of the slice of the headbox of the machine than is the case with respect to machines not fitted with the instant invention and with invariant exact parallelarity with reference to the frontal plane of the headbox at the rate of one inch per minute up to a maximum distance of six inches. It is at once evident that comparatively stated, the amount of paper and chemicals lost per day per mill as well as concomitant down time is greatly reduced. For example, a maximal adjustment of six inches would take only six minutes. Hence, at the very least with use of the instant invention, the comparative loss overall of paper and/or chemicals is only roughly 20% of such loss under the best of circumstances as would be the case in respect of resort to the current art of manually and visually adjusting forming boards "on the fly".

In conclusion, respectfully submitted, the instant invention is unquestionably revolutionary as respects the art of papermaking and concomitant forming board manipulation in terms of predictable uniformity with respect to the bond of paper being produced at any give time as well as with respect to the tremendous savings that are generated over time as regards erstwhile losses of paper and/or chemicals.

A DESCRIPTION OF THE DRAWINGS

FIG. 4 is a top plan view of a forming board not fitted with the instant invention in apposition to a headbox showing how the board is affixed bilaterally to each of two conventional baseplates.

FIG. 5 is a rear plan view of the forming board shown in FIG. 4.

FIG. 6 is a top plan view of a forming board in non-parallel apposition to a headbox.

FIG. 7 is an on-end view of paper slurry atop a forming board showing the uneven thickness of such slurry material in the event of non-parallel apposition of the forming board to a headbox.

A DESCRIPTION OF THE PREFERRED EMBODIMENT

Figure 1:
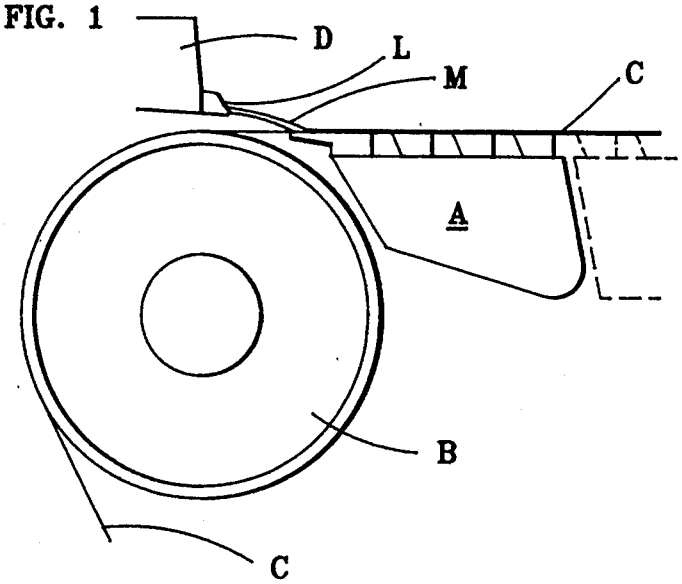
FIG. 1 is a lateral plan view of a headbox with papermaking slurry pouring forth onto the head of a forming board.
Figure 2:
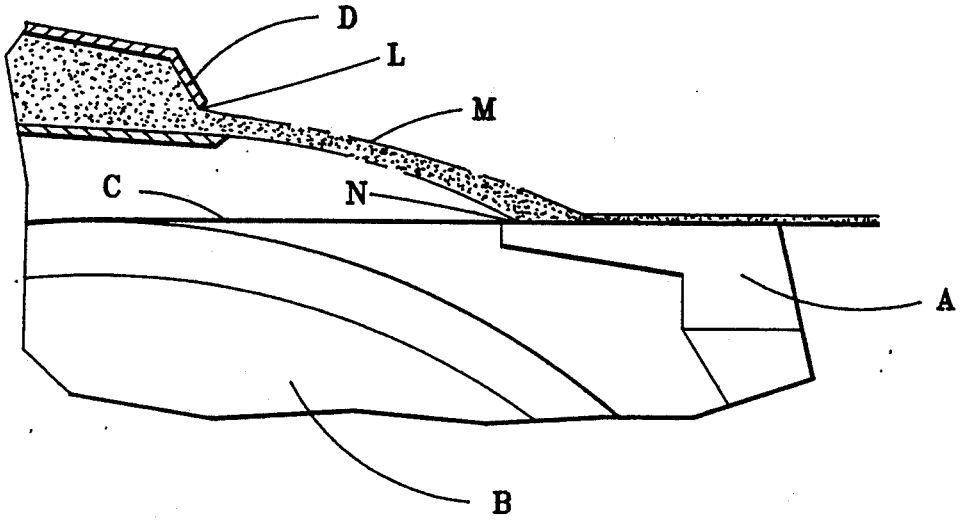
FIG. 2 is a closeup view of papermaking slurry emanating forth under pressure from the slice in a headbox and pouring forth as seen in FIG. 1 onto the head of a forming board.
Figure 3:
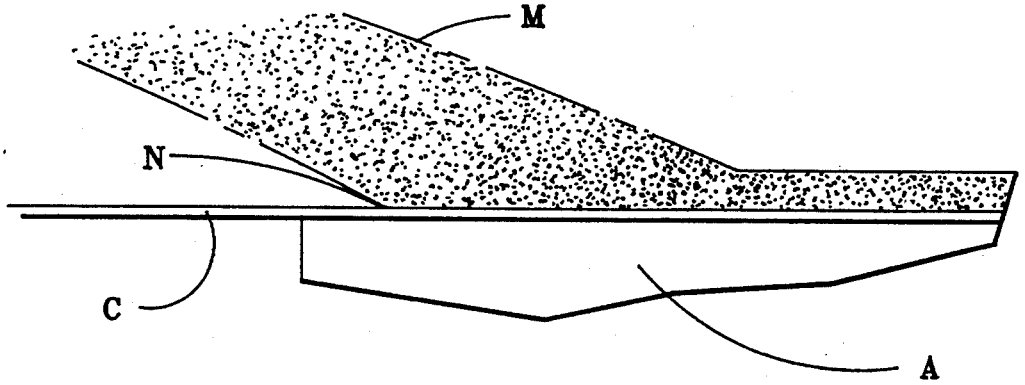
FIG. 3 is a closeup view of papermaking slurry as it impacts the head of a forming board.
Figure 8:
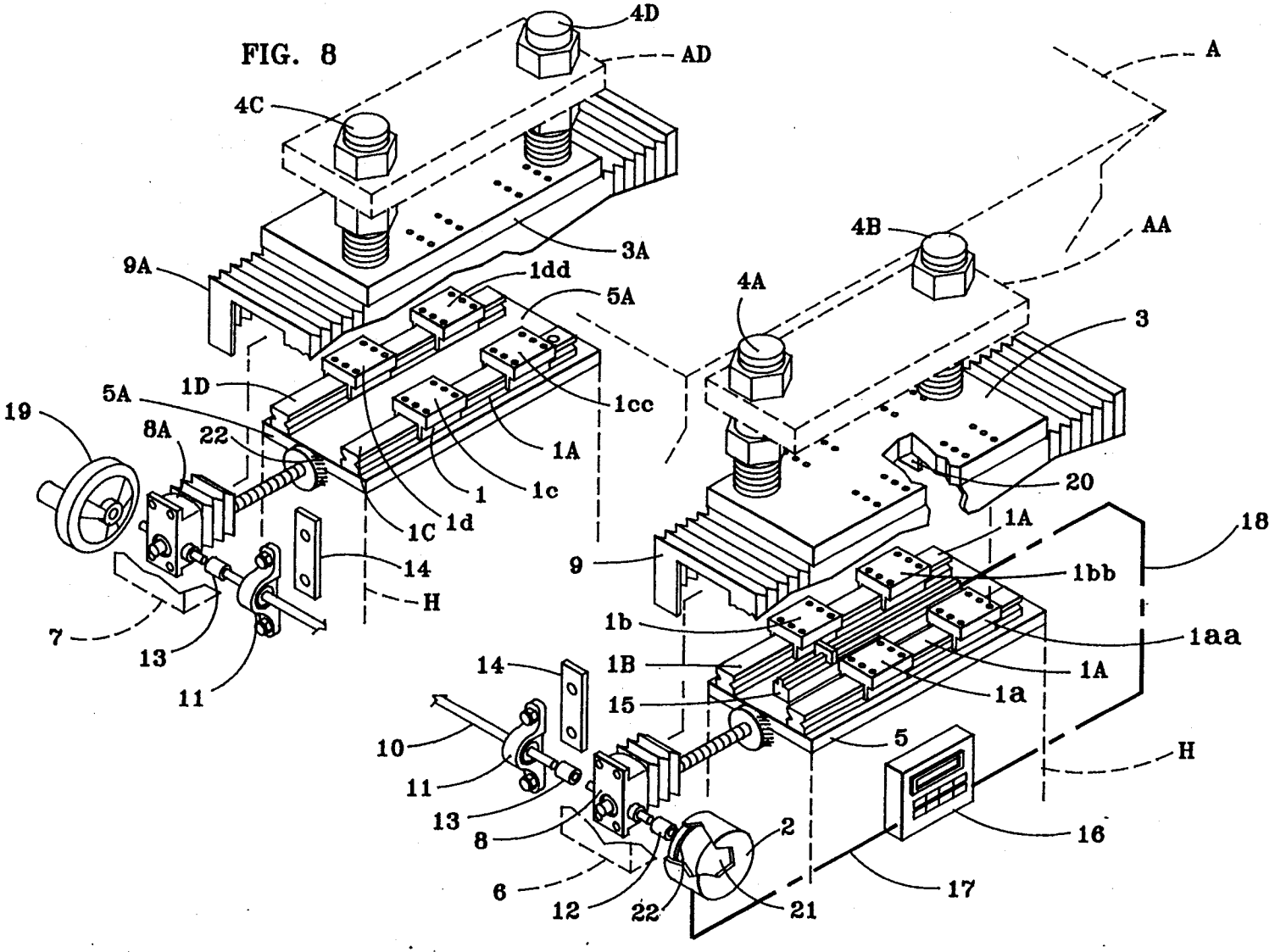
FIG. 8 is an exploded perspective view of all of the various components of the instant invention in relation to a forming board fitted or retro fitted with such components.
Figure 9:
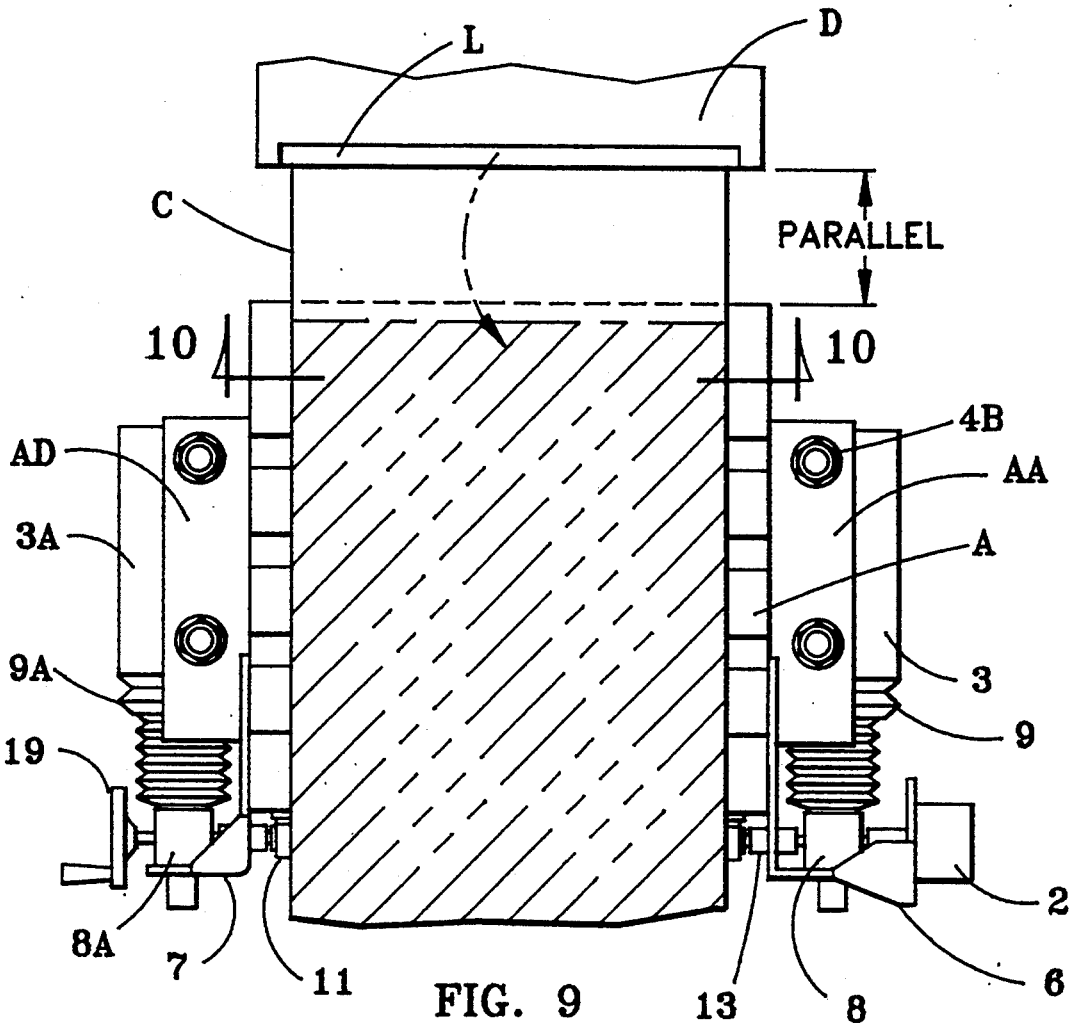
FIG. 9 is a top plan view of a forming board fitted or retrofitted with the instant invention in pure parallel aligmnent with the frontal plane of a headbox.
Figure 10:
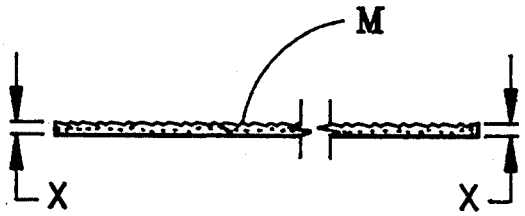
FIG. 10 is an on-end view of paper slurry atop a forming board showing its even thickness in view of the board's purely parallel apposition to an alignment with a headbox.
Figure 11:
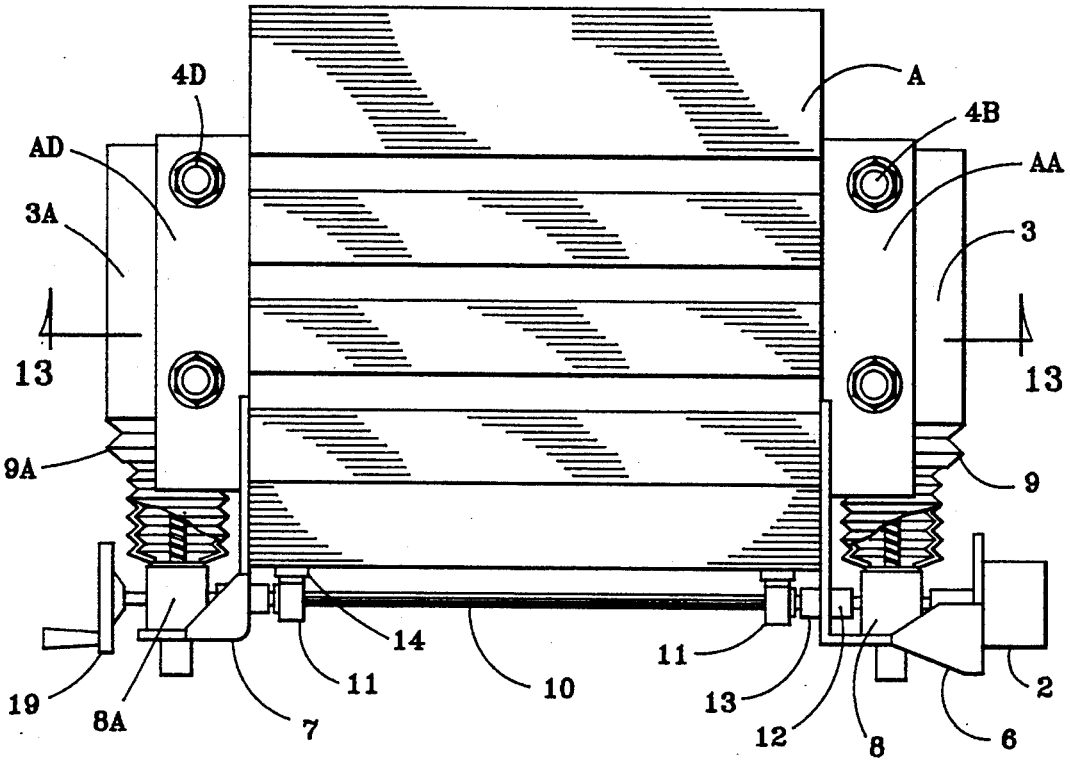
FIG. 11 is a top plan view of an isolated forming board fitted or retrofitted with the instant invention.
Figure 12:
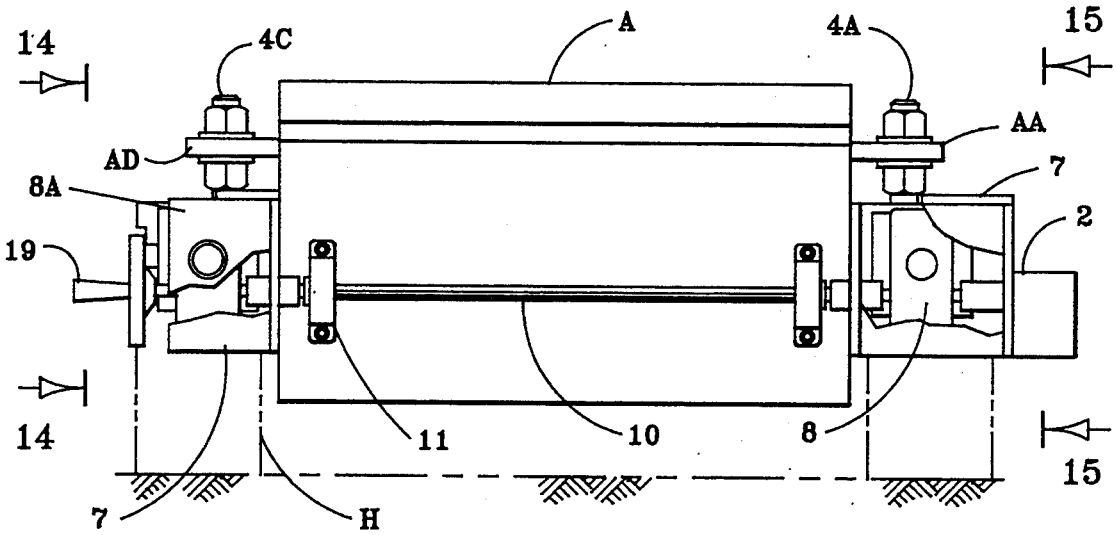
FIG. 12 is a frontal, partially cutaway view of an isolated forming board fitted or retrofitted with the instant invention.
Figure 13:
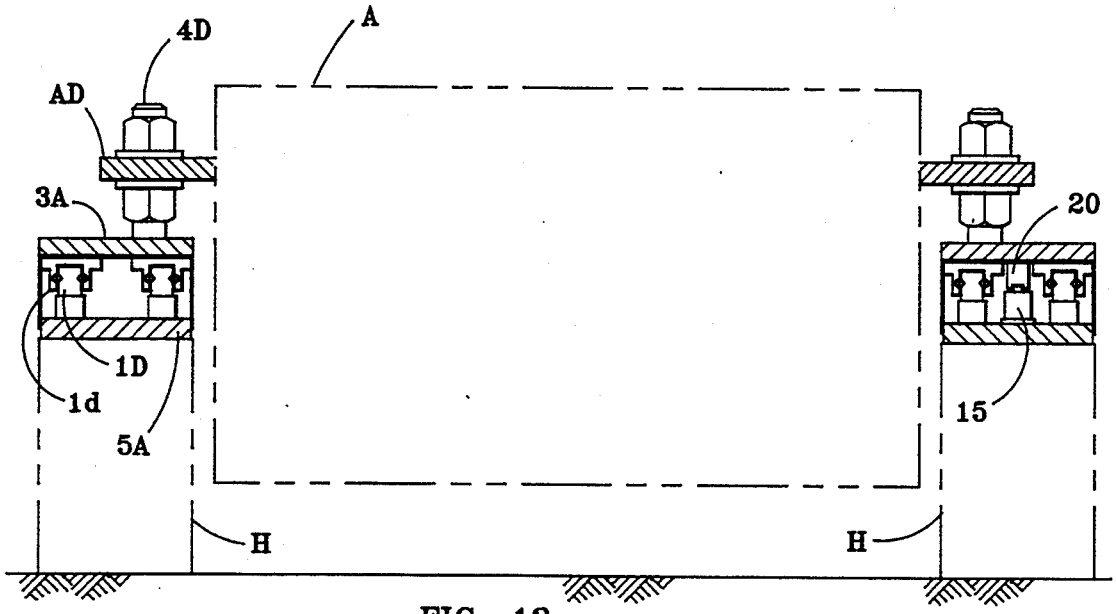
FIG. 13 is a longitudinal cross-sectional view of an isolated forming board fitted or retro fitted with the instant invention.
Figure 14:
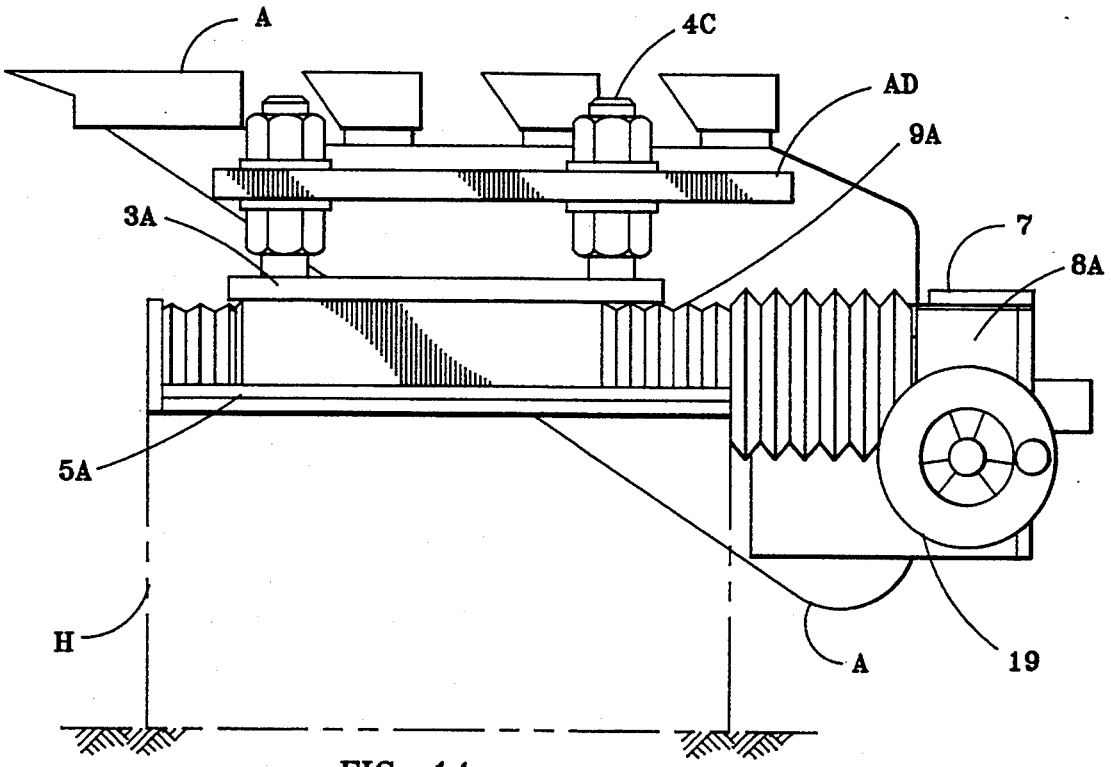
FIG. 14 is a right lateral plan view of an isolated forming board fitted or retrofitted with the instant invention.
Figure 15:
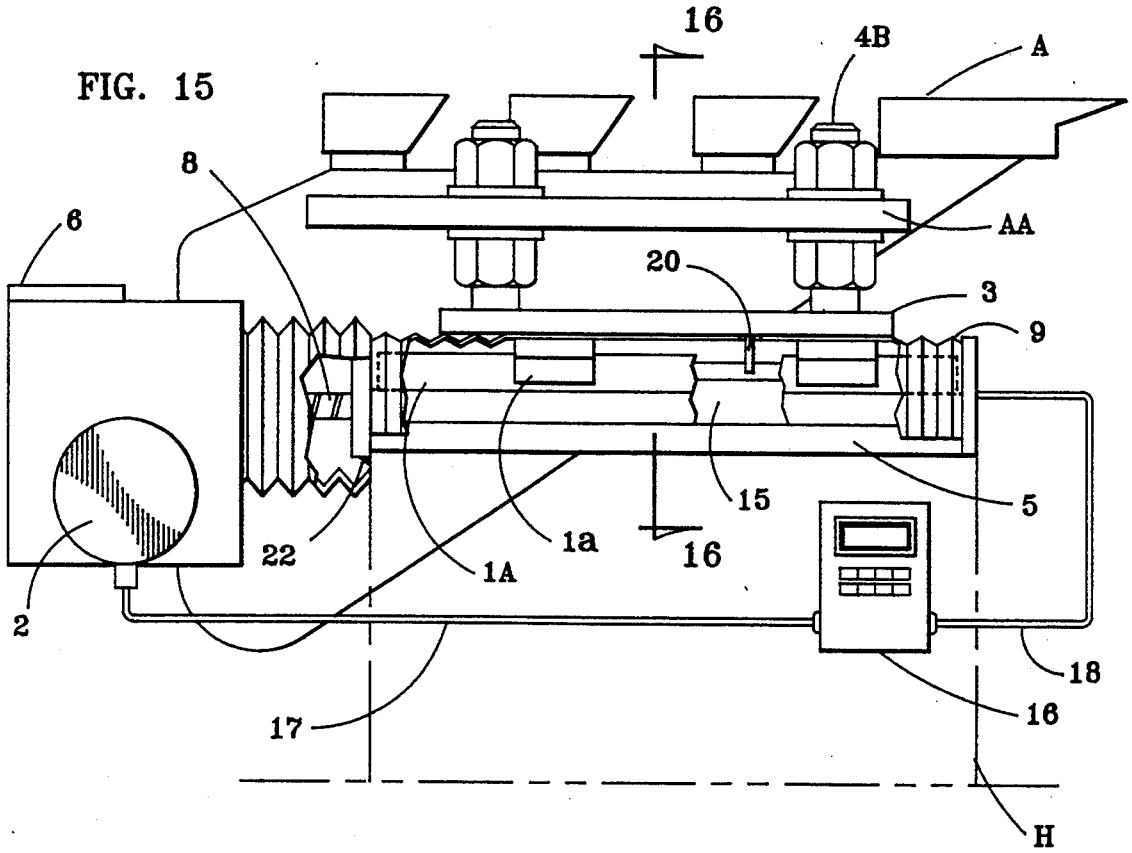
FIG. 15 is a left lateral plan view of an isolated forming board retrofitted with the instant invention.
Figure 16:
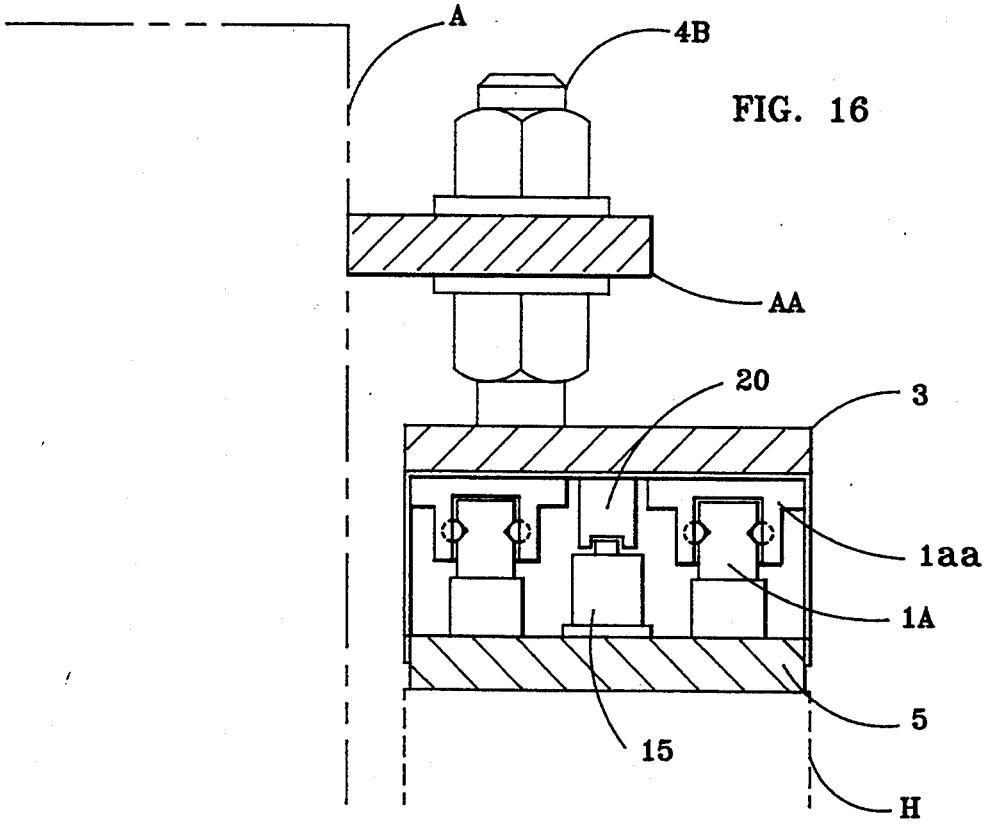
FIG. 16 is a cross-sectional isolated view of one of the two pairs of saddles on one of the instant invention's two parallel base plate track components.
Figure 17:
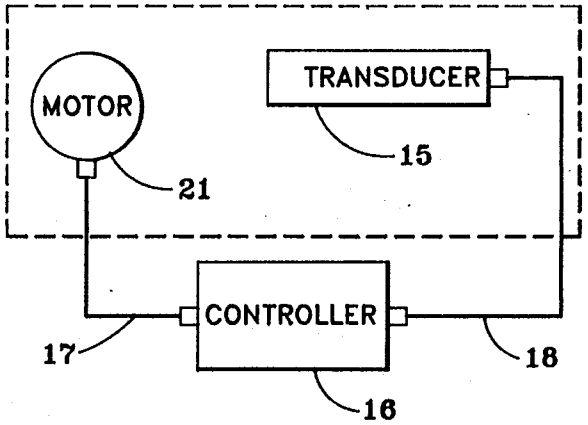
FIG. 17 is a schematic depiction of the instant invention's computer driven electronics.
Figure 18:
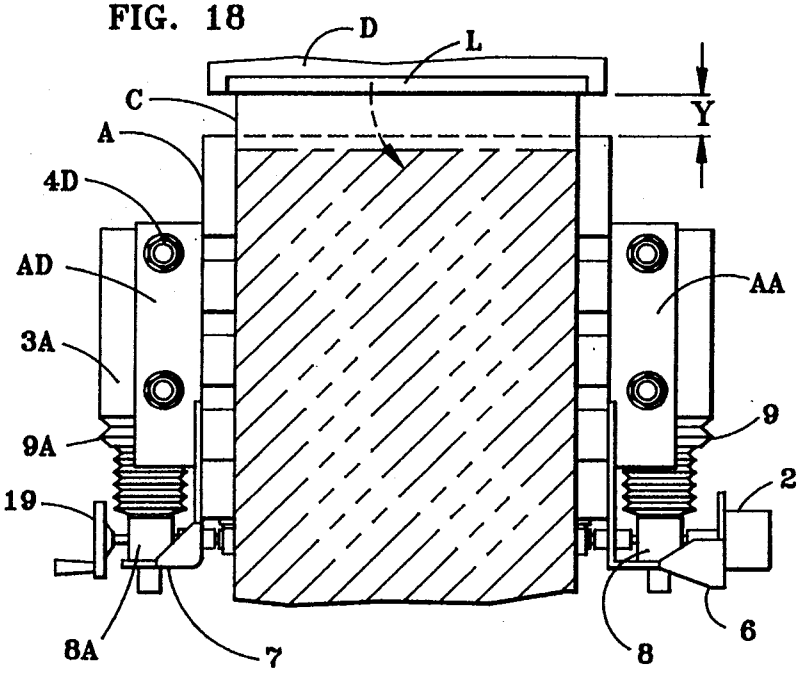
FIG. 18 is a top plan view of a forming board fitted or retrofitted with the instant invention set with precise parallelarity to and at a given distance from the frontal plane of a headbox.
Figure 19:
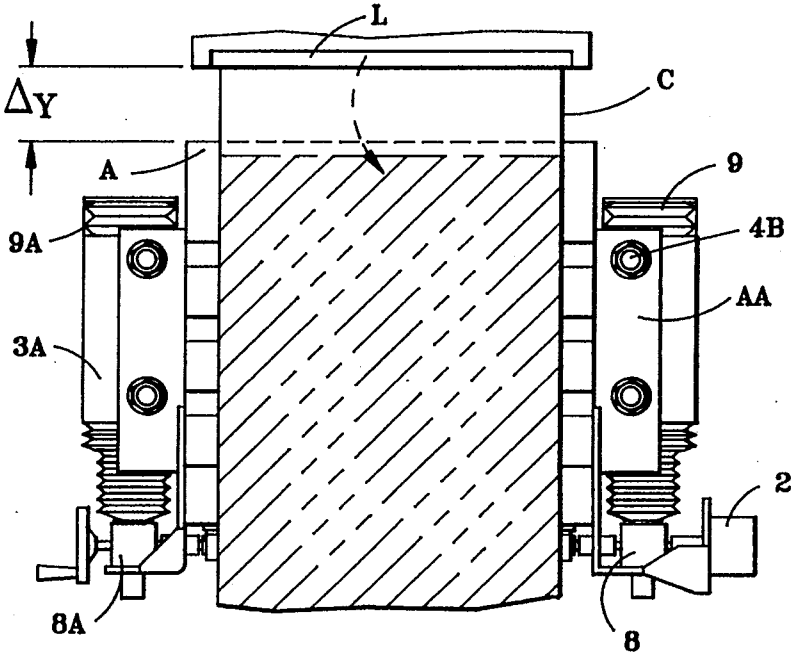
FIG. 19 is a top plan view of a forming board retrofitted with the instant invention set with precise parallelarity to and at a greater distance from the frontal plane of a headbox than the distance shown in FIG. 18.

FIG. 1 shows papermaking slurry material M emanating from a slice L in the frontal portion of a headbox D of a papermaking machine. Slurry M impacts a porous board screen C lying atop that papermaking machine's forming board A at an intercept point N. Screen C is moved forward atop forming board A by virtue of the action of a breast roller B. FIGS. 2 and 3 are successive close up views serving to isolate, in particular, an intercept point N where slurry material M actually impacts screen C. FIG. 4 is a top view of the locus of forming board A, a typical conventional forming board in relation to the locus of a typical headbox D. FIG. 5 is a vertically cut cross-sectional view of forming board A. FIG. 4 and FIG. 5 together serve to evidence the manner in which lateral extensions AA and AD on either side of forming board A are held and accordingly how forming board A is held conventionally in accordance with the current art of mounting such boards, namely, by way of four leveling bolt complexes J, to baseplates G which are in turn dovetail affixed to basemounts E affixed to basestands H. The longitudinal distance Y seen in FIG. 4 between slice L in headbox D and the trailing edge AB or rear of forming board A determines the intercept point N at which slurry M impacting screen C begins to first become paperlike. Distance Y also serves to determine the thickness or bond of the paper to be eventually formed. For example, as the length of distance Y increases, and correlatively the distance between slice L and intercept point N; a point in a straight line of slurry intercepts, which straight line lies hopefully parallel to the lie of slice L in the frontal plane of headbox D, increases, the thickness of paper to be formed decreases. As screen C with slurry material M advances forward under the impetus provided by breast roller B, the watery essence of slurry M decreases progressively with forward movement, since, the watery essence of slurry M drips continuously through pores in screen C onto forming board A and then through slits in the top surface of forming board A as slurry M is propelled forward atop screen C perforce of the action of breast roller B and the complementary action of a so-called couch roller which is found beyond the leading edge AC of board A which edge AC is located longitudinally opposite the trailing edge AB of board A which edge AB is located in the vicinity of breast roller B. As slurry L moves forward towards the above-mentioned couch roller, it becomes as just noted less watery and correspondingly more paperlike. As earlier mentioned, paper making machines are very large, massive and hence very inert. Consequently, they are almost never shut down except for scheduled maintenance. However, adjustments in the case of some to many of such machines often need to be made daily from time to time "on the fly" in order to permit the manufacture of paper of varying thickness or bond. Such adjustments require forming board positioning at varying set longitudinal distances from headbox D that correspond to the thickness or bond of paper desired at any given point in time. But, such positioning requires parallelarity as exact as possible in relation to the lie of slice L so that the thickness or bond of paper formed at any one time will be as uniform as possible. FIG. 6 shows a lack of parallelarity such as can easily occur and often does after thirty to sixty minutes of only manual adjusting while a machine is still running. Two people, one on each side of a forming board A making manual adjustments given, the limitations of their respective human visual perceptions can't be expected, even with their best efforts to very often, if at all, achieve pure parallelarity. One person on one side of a forming board A turns a wrench on a wheel and one on the other side does the same. But, unless they turn exactly the same fractions of or wholes of revolutions in exactly the same time starting at exactly the same time assuming pure parallelarity as between edge AB and the lie of slice L to begin with, the result will always be a relative lack of parallelarity. Such a relative lack of parallelarity will result in uneven thickness of slurry material M and ultimately in the production of a resultant relatively defective paper product. Such unevenness is predictably the cause of a goodly amount of product waste as was earlier noted not to mention, of course, as might be reasonably expected customer dissatisfaction as well. FIG. 7 demonstrates the variability in thickness of slurry M between thickness x and thickness $x_1$ and consequently, the uneven texture of a desired bond of resultant paper product due to the lack of parallelarity seen in FIG. 6. However, the instant device, as earlier noted represents a truly radical improvement in the art of forming board positioning. For example, longitudinal adjustments with respect to forming boards fitted with the instant device, can readily be made with start-stop tolerances of 0.005 inches at the rate of one inch per minute with no latitudinal deviations from pure parallelarity. Consequently, such adjustments can be completed in from one-fifth to one-tenth of the time required to complete such adjustments when performed as earlier noted in the currently conventional manner. When one contemplates the loss of paper product at the rate of 2700 feet of such product per minute per machine, the savings to be realized utilizing the instant device can readily be appreciated. Moreover, pure parallelarity achieved from the moment a forming board is originally and permanently fitted with the instant device is eminently preferable to the scenario whereby such desired pure parallelarity is pursued only by way of naked eyes and shouting back and forth between adjustors on either side of a very noisy running papermaking machine's forming board. FIG. 8 is an exploded perspective view of the various components of the instant devices in relation to a forming board A such as would be fitted or retrofitted with the instant device. Digital control panel unit 16, an encased computer unit with external numbered buttons on an external panel in response to digital settings pre-selected on such numbered buttons by an operator causes a motor 21 wire connected to panel unit 16 via cable 17 to actuate the turning of a worm gear screw jack 8 and, in turn, via a drive shaft 10, likewise, the turning of a second worm gear screw jack 8A which turning results in the longitudinal movement of a forming board either to or from a zero point in the vicinity of the frontal plane of a headbox D with longitudinal start-stop tolerance of 0.005 inches. Motor 21, a 407 horse power motor is capable of moving an 8000 pound forming board load at the rate of an inch a minute through a distance of up to six inches from the zero point. Pure parallelarity is achieved from the inception of original mounting of the instant device to a forming board A as follows. Two baseplates 5 and 5A are welded one each to each of two basestands H. Each baseplate 5 and 5A is in turn connected to a pair of identical linear motion tracks 1A and 1B, and 1C and 1D respectively atop of each of which said tracks 1A, 1B, 1C and 1D there are fitted two identical slidable saddles 1*a*, 1*aa*, 1*b*, 1*bb*, 1*c*, 1*cc*, 1*d* and 1*dd* respectively. Slidability with a very low coefficient of friction is made possible by way of ball bearings between the saddle and track assemblies. Permanently affixed to each four of such saddles 1*a*, 1*aa*, 1*b* and 1*bb* is one forming board mounting plate 3 and permanently affixed to each of the other four of such saddles 1*c*, 1*cc*, 1*d* and 1*dd* is a second forming board mounting plate 3A. Permanently affixed to one forming board mounting plate 3 via a pair of leveling nut and bolt assembly units 4A and is a shelf extension AA of a forming board A. Permanently affixed to the second forming board mounting plate 3A via a second pair of leveling nut and bolt assembly units 4C and 4D is a second shelf extension AA of the forming board A. An O ring sealed cover 2 encases motor 21 to protect it from papermaking debris and spray. An O ring 22 serves to effectuate such sealing. A pair of drive mounting brackets 6 and 7 are field welded to forming board A. Bracket 6 serves as the mounting area for motor 21 and worm gear screw jack 8. Bracket 7 serves as the mounting area for worm gear screw jack 8A. As can be noted with reference to the foregoing, drive brackets 6 for worm gear screw jack 8A. As can be noted with reference to the foregoing, drive brackets 6 and 7 and forming board mounting plates 3 and 3A via paired nut and bolt assembly units 4A and 4B and 4C and 4D are the means by which a fitting of a forming board A with the instant device is accomplished. Linear slide boot 9 and linear slide boot 9A cover respectively the instant invention's two linear motion systems each of which system consists of two tracks 1A and 1B and four slidable saddles 1*a*, 1*aa*, 1*a*, 1*bb* and two tracks 1C, 1D and four slidable saddles 1*c*, 1*cc*, 1*d* and 1*dd*. Boots 9 and 9A made of either a durable cloth or rubber material protect the two linear motion systems from papermaking debris and spray. A drive shaft 10 held via pillow block bearings 11 affixed to the front of a forming board A by way of spacer block bearing units 14 is connected to jacks 8 and 8A. This drive shaft 10 is actuated by a coupling drive shaft 12 that is, in turn, actuated by motor 21. Shaft coupling units 13 serve to lengthen drive shaft 10 so as to accommodate forming boards of varying latitudinal breadth. A handwheel 19 located on the side of a forming board A opposite to the side where motor 21 would be found serves as a means of effectuating longitudinal adjustment of a forming board fitted with the instant device in the event of a power failure that would render motor 21 inoperable. A mounting block with attached magnet 20 is affixed to the bottom side of mounting plate 3. Magnet 20 moves to and fro as does mounting plate 3 perforce of the to and fro motion of the saddles 1*a*, 1*aa*, 1*b* and 1*bb* to which it is mounted as jacks 8 and 8A cause forming board A to move to and fro by virtue of their actuation by motor 21 while being mounted to forming board A via mounting plates 6 and 7 respectively. Similarly, mounting plate 3A mounted to saddles 1*c*, 1*cc*, 1*d* and 1*dd* on tracks 1C and 1D also moves forming board A to and fro in unison with mounting plates. Such movement of mounted magnet 20 is over a transducer 15 mounted between tracks 1A and 1B atop baseplate 5 which transducer 15 is connected via transducer cable 18 to a controller computer encased with digital control panel unit 16. Movement of mounted magnet 20 to a point over transducer 15, predetermined by such computer controls encased within digital control unit 16 as per commands initiated by way of the digital manipulation of the external buttons on the display panel face of digital control unit 16, causes a signal from transducer 15 to be emitted over cable 18 to such computer controls. Such an emitted signal causes such computer controls to effectuate stoppage of motor 21 and concomitant stoppage of the action of jacks 8 and 8A and stasis of the formerly moving forming board A within a tolerance of 0.005 inches of distance from the point away from the frontal plane of headbox D where it is desired to effect stoppage of the to or fro longitudinal motion of forming board A. FIG. 9 shows in top plan view, the shelf portions of a forming board A fitted with the instant device. Pure parallelarity of board A's trailing edge AB with reference to the frontal plane of headbox D is apparent in FIG. 9. FIG. 10 evidences the even thickness of slurry material M which ultimately results in paper product of uniform bond or thickness being formed as a result of such pure parallelarity. FIG. 11 is a top plan view of a forming board A fitted with the instant device. FIG. 11 serves as a basis for facilitating the view in FIG. 13. The view in FIG. 13 illustrates tracks 1A, 1B and saddle 1*a*, 1*aa*, 1*b* and 1*bb* mounted magnet 20 and transducer 15 components, also seen in more pronounced isolation in FIG. 16, in place and in relation to one another as well as tracks 1C, 1D and saddles 1*c*, 1*cc*, 1*d* and 1*dd* in place and in relation to one another. FIG. 12 is a front plan view of a forming board A fitted with the instant device. FIG. 12 serves as a basis for facilitating the respective lateral views of a forming board A shown in FIGS. 14 and 15. In substance, digital commands given by way of manual manipulation of the buttons on the display panel of digital control unit 16 causes motor 21 to actuate jacks 8 and 8A to move forming board A to or fro until mounted magnet 20 is over that locus on and within transducer 15 that corresponds to the stop point contemplated within computer controls within digital control unit 16 as corresponds to a particular button or sequence of buttons on the panel of digital control unit 16 to be pushed by an operator. When mounted magnet 20 is over such a locus on and within transducer 15, such longitudinally to and fro motion is stopped such that forming board A's trailing edge AB is, with a tolerance of 0.005 inches, at a desired computer control contemplated locus between a first, to wit, a zero locus located but a fraction of an inch or so from the frontal plane of headbox D and a second locus located six inches from the first locus. FIG. 17 illustrates to the relationship between the computer controls within digital control unit 16, motor 21 and transducer 15. FIGS. 18 and 19 illustrates how with invariant pure parallelarity, a forming board A is fitted with the instant device is movable longitudinally from a first chosen locus Y units of distance from a zero locus to a second chosen locus other than Y units of distance from such zero locus. Finally, to or fro longitudinal motion is made possible as a result of the turning of jacks 8 and 8A mounted to mounts 6 and 7 as well as fast to basestands 4 respectively.

What is claimed is:

1. A forming board with a position control system, comprising:

a. a rotatable first drive shaft mounted to a front side of said forming board and connected, at close to a first end of said shaft, to a first worm gear jack, and, at close to a second end of said shaft, to a second worm gear jack positioned parallel to said first worm gear jack which said first worm gear jack and said second worm gear jack are both positioned perpendicular to said rotatable drive shaft;

b. said first worm gear jack being mounted to a first mounting bracket adjacent a first lateral side of said forming board which said first worm gear jack is also mounted to a flat front side of a first of two basestands that positionally support said forming board;

c. said second worm gear jack being mounted to a second mounting bracket mounted adjacent a second lateral side of said forming board which said second worm gear jack is also mounted to a flat front side of a second of said two basestands that positionally support said forming board;

d. a rotatable coupling drive shaft connected at a first end to said first end of said first drive shaft;

e. a motor mounted to said first mounting bracket and connected at a second end to said rotatable coupling drive shaft;

f. computer controlled electronics located within a digital control panel box;

g. wiring leading from said computer controlled electronics to said motor;

h. a first flat base plate mounted to a flat top side of said first of said two basestands;

i. a second flat base plate mounted to a flat top side of said second of said two basestands which said second flat base plate is mounted in a position parallel to the mounting of said first base plate;

j. two identical first and second tracks permanently mounted, parallel to one another to a top side of said first flat base plate;

k. two identical third and fourth tracks permanently mounted, parallel to one another, to a top side of said second flat base plate;

l. two identical first and second saddles slidably mounted permanently to said first track;

m. two identical third and fourth saddles slidably mounted permanently to said second track;

n. two identical fifth and sixth saddles slidably mounted permanently to said third track;

o. two identical seventh and eighth saddles slidably mounted permanently to said fourth track;

p. a first mounting plate permanently affixed to a flat bottom side of a first lateral extension of said forming board via a first pair of leveling bolt and nut assemblies and to said first saddle, said second saddle, said third saddle and said fourth saddle;

q. a second mounting plate permanently affixed via a second pair of leveling bolt and nut assemblies to a flat bottom side of a second lateral extension of said forming board located on the side of said forming board opposite the side where said first lateral extension is located and to said fifth saddle, said sixth saddle, said seventh saddle and said eighth saddle;

r. a stationary transducer mounted to said top side of said first flat base plate between said first track and said second track;

s. wiring leading from said transducer to said control electronics;

t. a magnet mounted to a bottom side of said first mounting plate in the same vertical plane within which said transducer is located.

2. The forming board position control system of claim 1 whereby a circular handwheel is attached to the second end of said rotatable first drive shaft.

3. The forming board position control system of claim 1, whereby said rotatable first drive shaft comprises a plurality of rotatable drive shafts connected by one or more shaft coupling units.

4. A forming board with a position control system, comprising:

a. a rotatable first drive shaft held by a plurality of pillow block holders affixed to a plurality of spacer block bearings mounted to a front side of said forming board and connected, at close to a first end of said shaft, to a first worm gear jack, and, at close to a second end of said shaft, to a second worm gear jack positioned parallel to said first worm gear jack which said first worm gear jack and said second worm gear jack are both positioned perpendicular to said rotatable drive shaft;

b. said first worm gear jack being mounted to a first mounting bracket adjacent a first lateral side of said forming board which said first worm gear jack is also mounted to a flat front side of a first of two basestands that positionally support said forming board;

c. said second worm gear jack being mounted to a second mounting bracket mounted adjacent a second lateral side of said forming board which said second worm gear jack is also mounted to a flat front side of a said of two basestands that positionally support said forming board;

d. a rotatable coupling drive shaft connected at a first end to said first end of said first drive shaft;

e. a motor mounted to said first mounting bracket and connected at a second end to said rotatable coupling drive shaft;

f. computer controlled electronics located within a digital control panel box;

g. wiring leading from said computer controlled electronics to said motor;

h. a first flat base plate mounted to a flat top side of said first of said two basestands;

i. a second flat base plate mounted to a flat top side of said second of said two basestands which said second fiat base plate is mounted in a position parallel to the mounting of said first base plate;

j. two identical first and second tracks permanently mounted, parallel to one another to a top side of said first flat base plate;

k. two identical third and fourth tracks permanently mounted, parallel to one another, to a top side of said second fiat base plate;

l. two identical first and second saddles slidably mounted permanently to said first track;

m. two identical third and fourth saddles slidably mounted permanently to said second track;

n. two identical fifth and sixth saddles slidably mounted permanently to said third track;

o. two identical seventh and eighth saddles slidably mounted permanently to said fourth track;

p. a first mounting plate permanently affixed to a flat bottom side of a first lateral extension of said forming board via a first pair of leveling bolt and nut assemblies and to said first saddle, said second saddle, said third saddle and said fourth saddle;

q. a second mounting plate permanently affixed via a second pair of leveling bolt and nut assemblies to a flat bottom side of a second lateral extension of said forming board located on the side of said forming board opposite the side where said first lateral extension is located and to said fifth saddle, said sixth saddle, said seventh saddle and said eighth saddle;

r. a stationary transducer mounted to said top side of said first flat base plate between said first track and said second track;

s. wiring leading from said transducer to said control electronics;

t. a magnet mounted to a bottom side of said first mounting plate in the same vertical plane within which said transducer is located;

u. a first boot attached to said bottom side of said first mounting plate and serving to encase said first track, said first saddle, said second saddle, said transducer, said second track, said third saddle, said fourth saddle and said magnet; transducer, said second track, said third saddle, said fourth saddle and said magnet;

v. a second boot attached to said bottom side of said second mounting plate and serving to encase said third track, said fifth saddle, said sixth saddle, said fourth track, said seventh saddle and said eighth saddle;

w. a motor cover serving to wholly encase said motor.

5. The forming board position control system of claim 4 whereby a circular handwheel is attached to the second end of said rotatable first drive shaft.

6. The forming board position control system of claim 4, whereby said rotatable first drive shaft comprises a plurality of rotatable drive shafts connected by one or more shaft coupling units.

* * * * *